US009169539B2

(12) United States Patent
Kumagai et al.

(10) Patent No.: US 9,169,539 B2
(45) Date of Patent: Oct. 27, 2015

(54) CU-MG-P-BASED COPPER ALLOY SHEET HAVING EXCELLENT FATIGUE RESISTANCE CHARACTERISTIC AND METHOD OF PRODUCING THE SAME

(75) Inventors: Jun-Ichi Kumagai, Aizuwakamatsu (JP); Yoshio Abe, Aizuwakamatsu (JP); Shunroku Sukumoda, Aizuwakamatsu (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 210 days.

(21) Appl. No.: 14/007,756

(22) PCT Filed: Apr. 4, 2012

(86) PCT No.: PCT/JP2012/059257

§ 371 (c)(1),
(2), (4) Date: Sep. 26, 2013

(87) PCT Pub. No.: WO2013/150627

PCT Pub. Date: Oct. 10, 2013

(65) Prior Publication Data

US 2014/0209221 A1 Jul. 31, 2014

(51) Int. Cl.

| | |
|---|---|
| ***C22F 1/08*** | (2006.01) |
| ***C22C 9/05*** | (2006.01) |
| ***C22C 9/00*** | (2006.01) |
| ***H01B 1/02*** | (2006.01) |
| *C22C 1/10* | (2006.01) |

(52) U.S. Cl.
CPC ... *C22C 9/05* (2013.01); *C22C 9/00* (2013.01); *C22F 1/08* (2013.01); *H01B 1/026* (2013.01); *C22C 1/10* (2013.01)

(58) Field of Classification Search
CPC ..... C22C 9/00; C22C 9/05; C22C 1/10; C22F 1/08
See application file for complete search history.

(56) References Cited

U.S. PATENT DOCUMENTS

2011/0146855 A1 6/2011 Sakurai et al.

FOREIGN PATENT DOCUMENTS

| | | | |
|---|---|---|---|
| JP | 06-340938 | A | 12/1994 |
| JP | 09-157774 | A | 6/1997 |
| JP | 2009-228013 | A | 10/2009 |
| JP | 4516154 | B1 | 8/2010 |
| JP | 4563508 | B1 | 10/2010 |
| JP | 2012-007231 | A | 1/2012 |

*Primary Examiner* — Rebecca Lee
(74) *Attorney, Agent, or Firm* — Locke Lord LLP

(57) ABSTRACT

The fatigue resistance characteristics, particularly, fatigue resistance characteristics after retention at 150° C. for 1000 hours are improved while maintaining the characteristics in the related art. Provided is a copper alloy sheet having a composition containing 0.2% by mass to 1.2% by mass of Mg, and 0.001% by mass to 0.2% by mass of P, the balance being Cu and unavoidable impurities. When X-ray diffraction intensity of a {110} crystal plane is set as I{110}, and X-ray diffraction intensity of {110} crystal plane of a pure copper standard powder is set as $I_0${110}, a surface crystal orientation of the copper alloy sheet satisfies a relation of $4.0 \leq I\{110\}/I_0\{110\} \leq 6.0$.

8 Claims, 1 Drawing Sheet

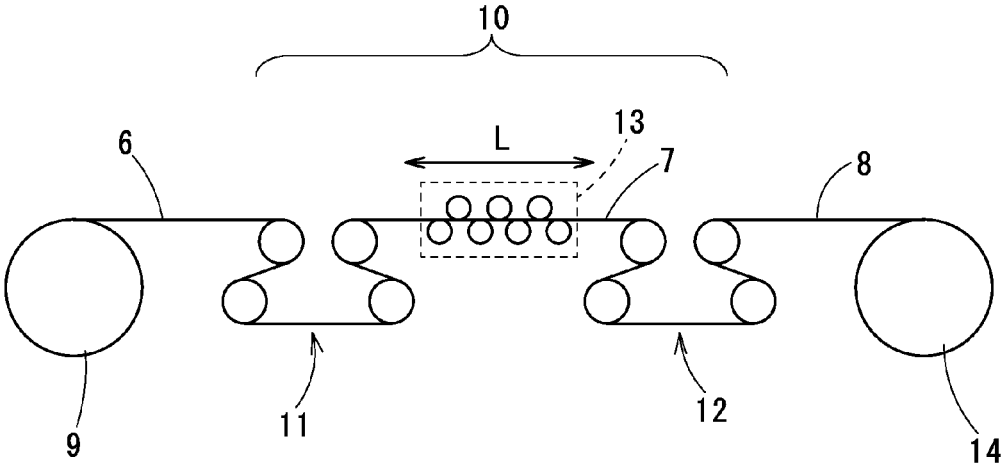
10
L
13
6
7
8
9
11
12
14

CU-MG-P-BASED COPPER ALLOY SHEET HAVING EXCELLENT FATIGUE RESISTANCE CHARACTERISTIC AND METHOD OF PRODUCING THE SAME

TECHNICAL FIELD

The present invention relates to a Cu—Mg—P-based copper alloy sheet having excellent fatigue resistance characteristics and a method of producing the same.

BACKGROUND ART

As a material for terminals and connectors of electric and electronic apparatuses, brass or phosphor bronze has been generally used. However, recently, reductions in size, thickness, and weight of an electronic apparatus such as a cellular phone and a note-type PC have been progressed. Accordingly, terminals and connector parts thereof, which have a small size and a narrow pitch between electrodes, have been used. In addition, in usage in the vicinity of an engine of a vehicle, reliability under harsh conditions at a high temperature is also required. Along with this, from necessity of maintaining electric connection reliability, strength, electrical conductivity, a bending elastic limit, stress relaxation characteristics, bending formability, fatigue resistance, and the like are demanded to be further improved, and thus brass and phosphor bronze may not cope with this demand. As a substitute for brass and phosphor bronze, the present applicant gives attention to a Cu—Mg—P-based copper alloy as described in PTL 1 to PTL 5, and has provided a copper alloy sheet (product name "MSP1") for terminals and connectors, which has excellent characteristics, high quality, and high reliability, to the market.

PTL 1 discloses a copper alloy thin sheet for producing connectors. The copper alloy thin sheet is composed of a copper alloy having a composition containing 0.3% by mass to 2% by mass of Mg, 0.001% by mass to 0.02% by mass of P, 0.0002% by mass to 0.0013% by mass of C, and 0.0002% by mass to 0.001% by mass of oxygen, the balance being Cu and unavoidable impurities, and having a structure in which oxide particles containing fine Mg having a grain size of 3 μm or less are uniformly distributed in a basis material.

PTL 2 discloses a drawn copper alloy bar stock which barely causes wear to a mold. The drawn copper alloy bar stock contains, in terms of % by weight, 0.1% to 1.0% of Mg, and 0.001% to 0.02% of P, and the balance being Cu and unavoidable impurities. In the bar stock, surface crystal grains have an elliptical shape, and have dimensions in which an average minor axis of the elliptical crystal grains is 5 μm to 20 μm, and a value of average major axis/average minor axis is 1.5 to 6.0. To form the elliptical crystal grains, adjustment is carried out so that an average grain size is maintained within a range of 5 μm to 20 μm at final annealing immediately before final cold rolling, and then a rolling rate at the final cold rolling process is set within a range of 30% to 85%.

PTL 3 discloses a Cu—Mg—P-based copper alloy in which tensile strength and bending elastic limit are highly balanced, and a method of producing the Cu—Mg—P-based copper alloy. The Cu—Mg—P-based copper alloy is a copper alloy bar stock having a composition containing, in terms of % by mass, 0.3% to 2% of Mg, and 0.001% to 0.1% of P, the balance being Cu and unavoidable impurities. In a case where orientations of all pixels in a surface within an area to be measured of the copper alloy bar stock are measured with an EBSD method by a scanning electron microscope equipped with an electron backscatter diffraction image system, and a boundary having an orientation difference of 5° or more between adjacent pixels is defined as a crystal grain boundary, an area ratio of crystal grains having an average orientation difference of less than 4° between all pixels in the crystal grains is 45% to 55% of the measured area, tensile strength is 641 N/mm$^2$ to 708 N/mm$^2$, and a bending elastic limit is 472 N/mm$^2$ to 503 N/mm$^2$.

PTL 4 discloses a Cu—Mg—P-based copper alloy bar stock, and a method of producing the Cu—Mg—P-based copper alloy bar stock. The Cu—Mg—P-based copper alloy bar stock has a composition containing, in terms of % by mass, 0.3% to 2% of Mg, and 0.001% to 0.1% of P, the balance being Cu and unavoidable impurities. In a case where orientations of all pixels in a surface within an area to be measured of the copper alloy bar stock are measured at a step size of 0.5 μm with an EBSD method by a scanning electron microscope equipped with an electron backscatter diffraction image system, and a boundary having an orientation difference of 5° or more between adjacent pixels is defined as a crystal grain boundary, an average value of the average orientation difference between all pixels within a crystal grain in all crystal grains is 3.8° to 4.2°, tensile strength is 641 N/mm2 to 708 N/mm2, a bending elastic limit is 472 N/mm$^2$ to 503 N/mm$^2$, and a stress relaxation rate after a heat treatment at 200° C. for 1000 hours is 12% to 19%.

PTL 5 discloses a copper alloy bar stock and a method of producing the copper alloy bar stock. The copper alloy bar stock has a composition containing, in terms of % by mass, 0.3% to 2% of Mg, and 0.001% to 0.1% of P, the balance being Cu and unavoidable impurities. In a case where orientations of all pixels in a surface within an area to be measured of the copper alloy bar stock are measured at a step size of 0.5 μm with an EBSD method by a scanning electron microscope equipped with an electron backscatter diffraction image system, and a boundary having an orientation difference of 5° or more between adjacent pixels is defined as a crystal grain boundary, an area ratio of crystal grains having an average orientation difference of less than 4° between all pixels in the crystal grains is 45% to 55% of the measured area, an area average GAM of crystal grains present in the measured area is 2.2° to 3.0°, tensile strength 641 N/mm$^2$ to 708 N/mm2, a bending elastic limit is 472 N/mm$^2$ to 503 N/mm$^2$, and fatigue limit under completely reversed plane bending in the number of repetition times of 1×106 is 300 N/mm$^2$ to 350 N/mm$^2$.

In addition, PTL 6 discloses a cheap copper alloy sheet material which is excellent in not only ordinary bending formability but also bending formability after notching while maintaining high electrical conductivity and high strength, and is excellent in stress relaxation resistance characteristics, and a method of producing the copper alloy sheet material. The copper alloy sheet material has a composition containing 0.2% by mass to 1.2% by mass of Mg, and 0.001% by mass to 0.2% by mass of P, and the balance being Cu and unavoidable impurities. When X-ray diffraction intensity of a {420} crystal plane in a sheet surface of the copper alloy sheet material is set as I{420}, and X-ray diffraction intensity of a {420} crystal plane of a pure copper standard powder is set as I0{420}, the copper alloy sheet has a crystal orientation satisfying a relation of I{420}/I0{420}>1.0, and when X-ray diffraction intensity of a {220} crystal plane in a sheet surface of the copper alloy sheet material is set as I{220}, and X-ray diffraction intensity of a {220} crystal plane of the pure copper standard powder is set as I0{220}, the copper alloy sheet has a crystal orientation satisfying a relation of 1.0≤I{220}/I0{220}3.5.

CITATION LIST

Patent Literature

[PTL 1] JP-A-9-157774
[PTL 2] JP-A-6-340938
[PTL 3] Japanese Patent No. 4516154
[PTL 4] Japanese Patent No. 4563508
[PTL 5] JP-A-2012-007231
[PTL 6] JP-A-2009-228013

SUMMARY OF INVENTION

Technical Problem

The Cu—Mg—P-based copper alloy sheets, which are based on PTL 1 to PTL 5 and are excellent in quality, have been produced and sold with a product name "MSP1" by the present applicant, and have been widely used as terminal and connector materials. However, to increase reliability under a harsh usage environment, for example, under usage at a high temperature in the vicinity of an engine of a vehicle due to a recent demand of the market, additional fatigue resistance characteristics are frequently required.

An object of the invention is to provide a Cu—Mg—P-based copper alloy sheet having excellent fatigue resistance characteristics even after retention at 150° C. for 1000 hours (a numerical value obtained by assuming usage in an engine room of a vehicle) by improving "MSP1" that is a product name supplied by the present applicant, while maintaining characteristics, and a method of producing Cu—Mg—P-based copper alloy sheet.

Solution to Problem

The present inventors have made a thorough investigation in consideration of the above-described circumstances, and have found the following finding. With regard to the copper alloy sheet having a composition containing 0.2% by mass to 1.2% by mass of Mg, and 0.001% by mass to 0.2% by mass of P, the balance being Cu and unavoidable impurities, in a case where when X-ray diffraction intensity of a {110} crystal plane is set as I{110}, and X-ray diffraction intensity of a {110} crystal plane of a pure copper standard powder is set as $I_0\{110\}$, a surface crystal orientation of the copper alloy sheet satisfies a relation of $4.0 \leq I\{110\}/I_0\{110\} \leq 6.0$, when X-ray diffraction intensity of a {100} crystal plane is set as I{100}, and X-ray diffraction intensity of a {100}crystal plane of the pure copper standard powder is set as $I_0\{100\}$, the surface crystal orientation of the copper alloy sheet satisfies a relation of $I\{100\}/I_0\{100\} \leq 0.8$, when X-ray diffraction intensity of a {111} crystal plane is set as I{111}, and X-ray diffraction intensity of a {111} crystal plane of the pure copper standard powder is set as $I_0\{111\}$, the surface crystal orientation of the copper alloy sheet satisfies a relation of $I\{111\}/I_0\{111\} \leq 0.8$, and an average grain size of the copper alloy sheet is 1 μm to 10 μm, the copper alloy sheet exhibits excellent fatigue resistance characteristics while maintaining the characteristics in the related art.

PTL 6 discloses that in the copper alloy sheet material having a composition containing 0.2% by mass to 1.2% by mass of Mg, and 0.001% by mass to 0.2% by mass of P, the balance being Cu and unavoidable impurities, in a case where when X-ray diffraction intensity of a {420} crystal plane in a sheet surface of the copper alloy sheet material is set as I{420}, and X-ray diffraction intensity of a {420} crystal plane of a pure copper standard powder is set as $I_0\{420\}$, the copper alloy sheet has a crystal orientation satisfying a relation of $I\{420\}/I_0\{420\} > 1.0$, and when X-ray diffraction intensity of a {220} crystal plane in a sheet surface of the copper alloy sheet material is set as I{220}, and X-ray diffraction intensity of a {220} crystal plane of the pure copper standard powder is set as $I_0\{220\}$, the copper alloy sheet has a crystal orientation satisfying a relation of $1.0 \leq I\{220\}/I_0\{220\} \leq 3.5$, not only ordinary bending formability but also bending formability after notching is excellent, and stress relaxation resistance characteristics are excellent.

This patent literature discloses the followings. An X-ray diffraction pattern of the Cu—Mg—P-based copper alloy from a sheet surface (rolling surface) generally includes diffraction peaks of four crystal planes of {111}, {200}, {220}, and {311}, and X-ray diffraction intensity from other crystal planes is very weak compared to the X-ray diffraction intensity of these crystal planes. In addition, in a Cu—Mg—P-based copper alloy sheet material which is produced according to an ordinary production method, X-ray diffraction intensity from {420} plane becomes weak to a negligible degree. However, according an embodiment of a method of producing the copper alloy sheet material in this patent literature, a Cu—Mg—P-based copper alloy sheet material having a texture in which {420} is a main orientation component can be produced, and as the texture is strongly developed, it is advantageous to improve the bending formability.

Differently from this consideration, in the Cu—Mg—P-based copper alloy sheet of the invention, during a process of improving fatigue resistance characteristics of "MSP1" that is a product name supplied by the present applicant, a {110} crystal plane in a surface crystal orientation of the copper alloy sheet is adjusted to satisfy the relation of $4.0 \leq I\{110\}/I_0\{110\} \leq 6.0$, a {100} crystal plane is adjusted to satisfy the relation of $I\{100\}/I_0\{100\} \leq 0.8$, and a {111} crystal plane is adjusted to satisfy the relation of $I\{111\}/I_0\{111\} \leq 0.8$. That is, the present inventors have found that when the formation of the two crystal planes ({100}, and {111}) is suppressed to the utmost, and the average grain size of the copper alloy sheet is set to 1.0 μm to 10.0 μm, the fatigue resistance characteristics after retention at 150° C. for 1000 hours are improved while maintaining the characteristics in the related art.

The characteristics in the related art represent various physical and mechanical characteristics corresponding to ¼ H material, ½ H material, H material, EH material, and SH material of "MSP1" that is a product name supplied by the present applicant.

In addition, in the Cu—Mg—P-based copper alloy sheet in the related art, the fatigue resistance characteristics after retention at 150° C. for 1000 hours decreases from an ordinary temperature by more than 20% and approximately 25%. However, in the Cu—Mg—P-based copper alloy sheet of the invention, the fatigue resistance characteristics are suppressed to decrease by 15% to 20%.

Furthermore, with regard to a production method, the present inventors have found the following finding. During production of the above-described copper alloy sheet by a process of carrying out hot rolling, cold rolling, continuous annealing, finish cold rolling, and tension leveling in this order, when the hot rolling is carried out under conditions in which a rolling initiation temperature is 700° C. to 800° C., a total hot-rolling rate is 80% or more, and an average rolling rate for one pass is 15% to 30%, the cold rolling is carried out at a rolling rate of 50% or more, the continuous annealing is carried out at a temperature of 300° C. to 550° C. for 0.1 minutes to 10 minutes, and the tension leveling is carried out at a line tension of 10 N/mm$^2$ to 140 N/mm$^2$, the above-described $I\{110\}/I_0\{110\}$, $I\{100\}/I_0\{110\}$, $I\{111\}/I_0\{111\}$, and the average grain size are maintained within ranges of respective defined values, and thus the fatigue resistance characteristics, particularly, fatigue resistance characteristics after retention at 150° C. for 1000 hours are improved while maintaining the characteristics in the related art.

That is, according to an aspect of the invention, there is provided a Cu—Mg—P-based copper alloy sheet having excellent fatigue resistance characteristics which has a composition containing 0.2% by mass to 1.2% by mass of Mg, and 0.001% by mass to 0.2% by mass of P, the balance being Cu and unavoidable impurities. When X-ray diffraction intensity of a {110} crystal plane is set as I{110}, and X-ray diffraction intensity of a {110} crystal plane of a pure copper standard powder is set as $I_0\{110\}$, a surface crystal, orientation of the copper alloy sheet satisfies a relation of $4.0 \leq I\{110\}/I_0\{110\} \leq 6.0$, when X-ray diffraction intensity of a {100} crystal plane is set as I{100}, and X-ray diffraction intensity of a {100}crystal plane of the pure copper standard powder is set as $I_0\{100\}$, the surface crystal orientation of the copper alloy sheet satisfies a relation of $I\{100\}/I_0\{100\} \leq 0.8$, when X-ray diffraction intensity of a {111} crystal plane is set as I{111}, and X-ray diffraction intensity of a {111} crystal plane of the pure copper standard powder is set as $I_0\{111\}$, the surface crystal orientation of the copper alloy sheet satisfies a relation of $I\{111\}/I_0\{111\} \leq 0.8$, and an average grain size of the copper alloy sheet is 1 μm to 10 μm.

Mg is solid-soluted in a basis material of Cu, and improves strength without deteriorating electrical conductivity. In addition, P has a deoxidizing operation during melting and casting, and improves strength in a state of coexisting with an Mg component. When Mg and P are contained within the above-described ranges, characteristics thereof may be effectively exhibited.

The present inventors have found that following finding. When the {110} crystal plane in the surface crystal orientation of the copper alloy sheet is adjusted to satisfy the relation of $4.0 \leq \{110\}/I_0\{110\} \leq 6.0$, the {100} crystal plane is adjusted to satisfy the relation of $I\{100\}/I_0\{100\} \leq 0.8$, and the {111} crystal plane is adjusted to satisfy the relation of $I\{111\}/I_0\{111\} \leq 0.8$, that is, the formation of two crystal planes ({100}, and {111}) is suppressed to the utmost, and the average grain size of the copper alloy sheet is set to 1.0 μm to 10.0 μm, the fatigue resistance characteristics (particularly, the fatigue resistance characteristics after retention at 150° C. for 1000 hours) are improved while maintaining the characteristics in the related art.

That is, in the Cu—Mg—P-based copper alloy sheet in the related art, the fatigue resistance characteristics after retention at 150° C. for 1000 hours decreases from an ordinary temperature by more than 20% and approximately 25%. However, in the Cu—Mg—P-based copper alloy sheet of the invention, the fatigue resistance characteristics are suppressed to a decrease by 15% to 20%.

When all of the above-described four conditions ({110}, {100}, {111}, and average grain size) are not satisfied, the above-described effect may not be obtained.

The X-ray diffraction pattern of the Cu—Mg—P-based copper alloy from a sheet surface (rolling surface) generally includes diffraction peaks of four crystal planes of {111}, {200}, {220}, and {311}, and X-ray diffraction intensity of the {100} plane is very weak. However, in the invention, attention is given to the {100} plane, generation of the {100} plane is suppressed to the utmost. Furthermore, the {111} crystal plane is suppressed to satisfy a relation of $I\{111\}/I_0\{111\} \leq 0.8$. According to this, the fatigue resistance characteristics may be improved while maintaining the characteristics in the related art. In addition, when the average grain size of the copper alloy sheet is set to 1 μm to 10 μm, this effect may be incremented. It is desired to reduce the $I\{100\}/I_0\{100\}$ and $I\{111\}/I_0\{111\}$ to the utmost, but even though devising the production method, it is difficult to reduce these to less than 0.2.

Measurement of the X-ray diffraction intensity (X-ray diffraction integrated intensity) may be different depending on conditions. In the invention, a sample is prepared by polishing a sheet surface (rolling surface) of the copper alloy sheet using #1500 water-resistant paper, and with respect to a polished surface of the sample, the X-ray diffraction intensity I of each plane is measured by an X-ray diffraction device (XRD) under conditions of Mo—Kα rays, a tube voltage of 60 kV, and a tube current of 200 mA. Measurement with respect to the pure copper standard powder is carried out in this manner.

The Cu—Mg—P-based copper alloy sheet having excellent fatigue resistance characteristics of the invention may further contain 0.0002% by mass to 0.0013% by mass of C, and 0.0002% by mass to 0.001% by mass of oxygen.

C is an element that is hard to be introduced into pure copper, but when a minute amount of C is contained, there is an operation of suppressing large growth of oxides containing Mg. However, when the content of C is less than 0.0001% by mass, the effect is not sufficient. On the other hand, when the content of C is more than 0.0013% by mass, it exceeds a solid-solution limit, C precipitates at a crystal grain boundary, this precipitation causes intergranular cracking which leads to embrittlement, and thus cracking tends to occur during bending process. Accordingly, this range is not preferable. A more preferable range is 0.0003% by mass to 0.0010% by mass.

Oxygen forms oxides with Mg. When a minute amount of the oxides are present, this is effective for reducing wear of a punching mold. However, when the content is less than 0.0002% by mass, the effect is not sufficient. On the other hand, when the content is more than 0.001% by mass, oxides containing Mg are largely grown, and thus this range is not preferable. A more preferable range is 0.0003% by mass to 0.008% by mass.

In addition, the Cu—Mg—P-based copper alloy sheet having excellent fatigue resistance characteristics of the invention may further contain 0.001% by mass to 0.03% by mass of Zr.

When Zr is added in the content of 0.001% by mass to 0.03% by mass, this addition contributes to improvement of tensile strength and a bending elastic limit, and when the content is outside the addition range, the effect may not expected.

According to another aspect of the invention, there is provided a method of producing the Cu—Mg—P-based copper alloy sheet having excellent fatigue resistance characteristics. The method includes a process of carrying out hot rolling, cold rolling, continuous annealing, finish cold rolling, and tension leveling in this order to produce the copper alloy sheet. During the process, the hot rolling is carried out under conditions in which a hot rolling initiation temperature is 700° C. to 800° C., a total hot-rolling rate is 80% or more, and an average hot rolling rate for one pass is 15% to 30%. The cold rolling is carried out at a cold rolling rate of 50% or more. The continuous annealing is carried out at a temperature of 300° C. to 550° C. for 0.1 minutes to 10 minutes. The tension leveling is carried out at a line tension of 10 $N/mm^2$ to 140 $N/mm^2$.

As a method of producing the Cu—Mg—P-based copper alloy sheet, PTL 3, PTL 4, and PTL 5 of the present applicant disclose a method including a process of carrying out hot rolling, a solution treatment, finish cold rolling, and low-temperature annealing in this order to produce a copper alloy. During the process, the hot rolling is carried out under conditions in which a hot rolling initiation temperature is 700° C. to 800° C., a total hot rolling rate is 90% or more, an average rolling rate for one pass is 10% to 35%. Vickers hardness of the copper alloy sheet after the solution treatment is adjusted to 80 Hv to 100 Hv. The low-temperature annealing is carried out at 250° C. to 450° C. for 30 seconds to 180 seconds. PTL 4 of the present applicant discloses a method in which the finish cold rolling is carried out at a total rolling rate of 50% to 80%.

In addition, as a method of producing the Cu—Mg—P-based copper alloy sheet, PTL 6 discloses the following method. As hot rolling at 900° C. to 300° C., a first rolling pass is carried out at 900° C. to 600° C., and then rolling at a rolling rate of 40% or more is carried out at a temperature lower than 600° C. and equal to or higher than 300° C. Subsequently, cold rolling is carried out at a rolling rate of 85% or more. Then, recrystallization annealing at 400° C. to 700° C., finish cold rolling at a rolling rate of 20% to 70% are sequentially carried out to produce a copper alloy sheet material.

The method of producing the Cu—Mg—P-based copper alloy sheet according to the invention is a method obtained by improving the production methods disclosed in PTL 3, PTL 4, and PTL 5 of the present applicant. In the method of the invention, the {110} plane and the average grain size are maintained within the defined ranges by the tension leveling that is a subsequent process. That is, a bending process is repetitively carried out to apply tensile stress to the copper alloy sheet by optimal tension leveling, thereby increasing formation of the {110} plane to make a surface structure dense, reducing a stress that operates on individual grain boundaries, and lengthening fatigue lifetime of the copper alloy sheet.

The tension leveling represents a process of correcting flatness of a material by applying tension to a roller leveler, which allows the material to pass through rolls arranged in a zigzag fashion to bend the material in repetitive opposite directions, in a longitudinal direction. Line tension is tension that is loaded to the material inside the roller leveler by inlet-side and winding-side tension loading devices.

That is, the hot rolling is carried out under the conditions in which the rolling initiation temperature is 700° C. to 800° C., the total hot-rolling rate is 80% or more, and the average rolling rate for one pass is 15% to 30%, and the cold rolling is carried out at a rolling rate of 50% or more to produce a basis material, in which the four conditions of $I\{110\}/I_0\{110\}$, $I\{100\}/I_0\{100\}$, $I\{111\}/I_0\{111\}$, and the average grain size are maintained within the defined values (particularly, formation of {110} is incremented). In addition, the continuous annealing is carried out at a temperature of 300° C. to 550° C. for 0.1 minutes to 10 minutes to suppress recrystallization to the utmost during annealing, thereby suppressing formation of $I\{100\}/I_0\{100\}$ and $I\{111\}/I_0\{111\}$ within the defined values. The tension leveling is carried out at a line tension of 10 N/mm$^2$ to 140 N/mm$^2$ to increase $I\{110\}/I_0\{110\}$ to the defined range, and to maintain the average grain size within the defined range. When any one of the production conditions deviates, the four conditions of $I\{110\}/I_0\{110\}$, $I\{100\}/I_0\{100\}$, $I\{111\}/I_0\{111\}$, and the average grain size are not maintained within the defined values.

Advantageous Effects of Invention

According to the invention, a Cu—Mg—P-based copper alloy sheet having excellent fatigue resistance characteristics, and a method of producing the same are provided.

BRIEF DESCRIPTION OF DRAWINGS

FIG. 1 is a schematic diagram illustrating line tension that is loaded to a tension leveler used in the invention.

DESCRIPTION OF EMBODIMENTS

Hereinafter, an embodiment of the invention will be described in detail.

[Component Composition of Copper Alloy Sheet]

The Cu—Mg—P-based copper alloy sheet of the invention has a composition containing 0.2% to 1.2% of Mg, and 0.001% to 0.2% of P, the balance being Cu and unavoidable impurities.

Mg is solid-soluted in a basis material of Cu, and improves strength without deteriorating electrical conductivity. In addition, P has a deoxidizing operation during melting and casting, and improves strength in a state of coexisting with an Mg component. When Mg and P are contained within the above-described ranges, characteristics thereof may be effectively exhibited.

In addition, with regard to the basic composition, the Cu—Mg—P-based copper alloy sheet of the invention may further contain 0.0002% by mass to 0.0013% by mass of C, and 0.0002% by mass to 0.001% by mass of oxygen.

C is an element that is hard to be introduced into pure copper, but when a minute amount of C is contained, there is an operation of suppressing large growth of oxides containing Mg. However, when the content of C is less than 0.0001% by mass, the effect is not sufficient. On the other hand, when the content of C is more than 0.0013% by mass, it exceeds a solid-solution limit, C precipitates at a crystal grain boundary, this precipitation causes intergranular cracking which leads to embrittlement, and thus cracking tends to occur during bending process. Accordingly, this range is not preferable. A more preferable range is 0.0003% by mass to 0.0010% by mass.

Oxygen forms oxides with Mg. When a minute amount of the oxides are present, this is effective for reducing wear of a punching mold. However, when the content is less than 0.0002% by mass, the effect is not sufficient. On the other hand, when the content is more than 0.001% by mass, oxides containing Mg are largely grown, and thus this range is not preferable. A more preferable range is 0.0003% by mass to 0.008% by mass.

In addition, with regard to the basic composition, or with regard to the composition further containing C and oxygen to the basic composition, the Cu—Mg—P-based copper alloy sheet of the invention may further contain 0.001% by mass to 0.03% by mass of Zr.

When Zr is added in the content of 0.001% by mass to 0.03% by mass, this addition contributes to improvement of tensile strength and a bending elastic limit, and when the content is outside the addition range, the effect may not be expected.

[Texture of Copper Alloy Sheet]

In the Cu—Mg—P-based copper alloy sheet of the invention, when X-ray diffraction intensity of a {110} crystal plane is set as $I\{110\}$, and X-ray diffraction intensity of a {110} crystal plane of a pure copper standard powder is set as $I_0\{110\}$, a surface crystal orientation of the copper alloy sheet satisfies a relation of $4.0 \leq I\{110\}/I_0\{110\} \leq 6.0$. When X-ray diffraction intensity of a {100} crystal plane is set as I{100}, and X-ray diffraction intensity of a {100} crystal plane of the pure copper standard powder is set as $I_0\{100\}$, the surface crystal orientation of the copper alloy sheet satisfies a relation of $I\{100\}/I_0\{100\} \leq 0.8$. When X-ray diffraction intensity of a {111} crystal plane is set as I{111}, and X-ray diffraction intensity of a {111} crystal plane of the pure copper standard powder is set as $I_0\{111\}$, the surface crystal orientation of the copper alloy sheet satisfies a relation of $I\{111\}/I_0\{111\} \leq 0.8$. In addition, an average grain size of the copper alloy sheet is 1 μm to 10 μm.

PTL 6 discloses that in the copper alloy sheet material having a composition containing 0.2% by mass to 1.2% by mass of Mg, and 0.001% by mass to 0.2% by mass of P, the balance being Cu and unavoidable impurities, in a case where when X-ray diffraction intensity of a {420}crystal plane in a sheet surface of the copper alloy sheet material is set as I{420}, and X-ray diffraction intensity of a {420} crystal plane of a pure copper standard powder is set as $I_0\{420\}$, the copper alloy sheet has a crystal orientation satisfying a relation of $I\{420\}/I_0\{420\} > 1.0$, and when X-ray diffraction intensity of a {220} crystal plane in a sheet surface of the copper alloy sheet material is set as I{220}, and X-ray diffraction intensity of a {220} crystal plane of the pure copper standard powder is set as $I_0\{220\}$, the copper alloy sheet has a crystal orientation satisfying a relation of $1.0 \leq I\{220\}/I_0\{220\} \leq 3.5$, not only ordinary bending formability but also bending formability after notching is excellent, and stress relaxation resistance characteristics are excellent.

Differently from the finding of PTL 6, in the Cu—Mg—P-based copper alloy sheet of the invention, during a process of improving fatigue resistance characteristics of "MSP1" that is a product name supplied by the present applicant, a {110} crystal plane in a surface crystal orientation of the copper alloy sheet is adjusted to satisfy the relation of $4.0 \leq I\{110\}/I_0\{110\} \leq 6.0$, a {100} crystal plane is adjusted to satisfy the relation of $I\{100\}/I_0\{100\} \leq 0.8$, and a {111} crystal plane is adjusted to satisfy the relation of $I\{111\}/I_0\{111\} \leq 0.8$. That is, the present inventors have found that when the formation of the two crystal planes ({100}, and {111}) is suppressed to the utmost, and the average grain size of the copper alloy sheet is set to 1.0 μm to 10.0 μm, the fatigue resistance characteristics after retention at 150° C. for 1000 hours are improved while maintaining the characteristics in the related art.

That is, in the Cu—Mg—P-based copper alloy sheet in the related art, the fatigue resistance characteristics after retention at 150° C. for 1000 hours decreases from an ordinary temperature by more than 20% and approximately 25%. However, in the Cu—Mg—P-based copper alloy sheet of the invention, the fatigue resistance characteristics are suppressed to a decrease by 15% to 20%.

When all of the above-described four conditions ({110}, {100}, {111}, and average grain size) are not satisfied, the above-described effect may not be obtained.

The characteristics in the related art represent various physical and mechanical characteristics corresponding to ¼ H material, ½ H material, H material, EH material, and SH material of "MSP1" that is a product name supplied by the present applicant.

The X-ray diffraction pattern of the Cu—Mg—P-based copper alloy from a sheet surface (rolling surface) generally includes diffraction peaks of four crystal planes of {111}, {200}, {220}, and {311}, and X-ray diffraction intensity of the {100} plane is very weak. However, in the invention, attention is given to the {100} plane, generation of the {100} plane is suppressed to the utmost. Furthermore, the {111} crystal plane is suppressed to satisfy a relation of $I\{111\}/I_0\{111\} \leq 0.8$. According to this, the fatigue resistance characteristics may be improved while maintaining the characteristics in the related art. In addition, when the average grain size of the copper alloy sheet is set to 1 μm to 10 μm, this effect may be incremented. It is desired to reduce the $I\{100\}/I_0\{100\}$ and $I\{111\}/I_0\{111\}$ to the utmost, but even though devising the production method, it is difficult to reduce these to less than 0.2.

Measurement of the X-ray diffraction intensity (X-ray diffraction integrated intensity) may be different depending on conditions. In the invention, a sample is prepared by polishing a sheet surface (rolling surface) of the copper alloy sheet using #1500 water-resistant paper, and with respect to a polished surface of the sample, the X-ray diffraction intensity I of each plane is measured by an X-ray diffraction device (XRD) under conditions of Mo—Kα rays, a tube voltage of 60 kV, and a tube current of 200 mA. Measurement with respect to the pure copper standard powder is carried out in this manner.

[Method of Producing Copper Alloy Sheet]

A method of producing the Cu—Mg—P-based copper alloy sheet having excellent fatigue resistance characteristics of the invention includes a process of carrying out hot rolling, cold rolling, continuous annealing, finish cold rolling, and tension leveling in this order to produce the copper alloy sheet. During the process, the hot rolling is carried out under conditions in which a rolling initiation temperature is 700° C. to 800° C., a total hot-rolling rate is 80% or more, and an average rolling rate for one pass is 15% to 30%. The cold rolling is carried out at a rolling rate of 50% or more. The continuous annealing is carried out at a temperature of 300° C. to 550° C. for 0.1 minutes to 10 minutes. The tension leveling is carried out at a line tension of 10 $N/mm^2$ to 140 $N/mm^2$.

As a method of producing the Cu—Mg—P-based copper alloy sheet, PTL 3, PTL 4, and PTL 5 of the present applicant disclose a method including a process of carrying out hot rolling, a solution treatment, finish cold rolling, and low-temperature annealing in this order to produce a copper alloy. During the process, the hot rolling is carried out under conditions in which a hot rolling initiation temperature is 700° C. to 800° C., a total hot rolling rate is 90% or more, an average rolling rate for one pass is 10% to 35%. Vickers hardness of the copper alloy sheet after the solution treatment is adjusted to 80 Hv to 100 Hv. The low-temperature annealing is carried out at 250° C. to 450° C. for 30 seconds to 180 seconds. PTL 4 of the present applicant discloses a method in which the finish cold rolling is carried out at a total rolling rate of 50% to 80%.

In addition, as a method of producing the Cu—Mg—P-based copper alloy sheet, PTL 6 discloses the following method. As hot rolling at 900° C. to 300° C., a first rolling pass is carried out at 900° C. to 600° C., and then rolling at a rolling rate of 40% or more is carried out at a temperature lower than 600° C. and equal to or higher than 300° C. Subsequently, cold rolling is carried out at a rolling rate of 85% or more. Then, recrystallization annealing at 400° C. to 700° C., finish cold rolling at a rolling rate of 20% to 70% are sequentially carried out to produce a copper alloy sheet material.

The method of producing the Cu—Mg—P-based copper alloy sheet according to the invention is a method obtained by improving the production methods disclosed in PTL 3, PTL 4, and PTL 5 of the present applicant. In the method of the invention, the {110} plane and the average grain size are maintained within the defined ranges by the tension leveling that is a subsequent process. That is, a bending process is repetitively carried out to apply tensile stress to the copper alloy sheet by optimal tension leveling, thereby increasing formation of the {110} plane to make a surface structure dense, reducing a stress that operates on individual grain boundaries, and lengthening fatigue lifetime of the copper alloy sheet.

The tension leveling represents a process of correcting flatness of a material by applying tension to a roller leveler, which allows the material to pass through rolls arranged in a zigzag fashion to bend the material in repetitive opposite directions, in a longitudinal direction. Line tension is tension that is loaded to the material inside the roller leveler by inlet-side and winding-side tension loading devices.

As shown in FIG. 1, a copper alloy sheet 6 wound around an uncoiler 9 is allowed to pass through an inlet-side tension loading device 11 of a tension leveler 10, and is repetitively bent by a roller leveler 13 in which a plurality of rolls are arranged in a zigzag fashion, thereby producing a copper alloy sheet 7. After passing the winding-side tension loading device 12, a copper alloy sheet 8 is obtained, and the copper alloy sheet 8 is wound around recoiler 14. At this time, line tension L is loaded to the copper alloy sheet 7 between the inlet-side tension loading device 11 and the winding-side tension loading device 12 (the line tension L is uniform tension within the roller leveler 13).

In this manner, the hot rolling is carried out under the conditions in which the rolling initiation temperature is 700° C. to 800° C., the total hot-rolling rate is 80% or more, and the average rolling rate for one pass is 15% to 30%, and the cold rolling is carried out at a rolling rate of 50% or more to produce a basis material in which the four conditions of $I\{110\}/I_0\{110\}$, $I\{100\}/I_0\{100\}$, $I\{111\}/I_0\{111\}$, and the average grain size are maintained within the defined values (particularly, formation of {110} is incremented). In addition, the continuous annealing is carried out at a temperature of 300° C. to 550° C. for 0.1 minutes to 10 minutes to suppress recrystallization to the utmost during annealing, thereby suppressing formation of $I\{100\}/I_0\{100\}$ and $I\{111\}/I_0\{111\}$ within the defined values. The tension leveling is carried out at a line tension of 10 N/mm$^2$ to 140 N/mm$^2$ to increase $I\{110\}/I_0\{110\}$ to the defined range, and to maintain the average grain size within the defined range.

When any one of the production conditions deviates, the four conditions of $I\{110\}/I_0\{110\}$, $I\{100\}/I_0\{100\}$, $I\{111\}/I_0\{111\}$, and the average grain size are not maintained within the defined values, and the fatigue resistance effect which is expected may not be obtained.

EXAMPLE

A copper alloy having a composition shown in Table 1 was melt by an electric furnace under a reducing atmosphere to cast an ingot having a thickness of 150 mm, a width of 500 mm, and a length of 3000 mm. This cast ingot was subjected to hot rolling under conditions of a rolling initiation temperature, a total hot-rolling rate, and an average rolling rate for one pass shown in Table 1 to prepare a copper alloy sheet. Oxide scales on both surfaces of the copper alloy sheet were removed by a milling cutter to 0.5 mm, cold rolling was carried out at a rolling rate shown, in Table 1, continuous annealing shown in Table 1 was carried out, finish rolling at a rolling rate of 70% to 85% was carried out, and tension leveling shown in Table 1 was carried out to prepare Cu—Mg—P-based thin copper alloy sheets of Examples 1 to 10, and Comparative Examples 1 to 7, which had a thickness of approximately 0.2 mm. Examples 1 to 10 are products corresponding to "H materials" for respective qualities of product name "MSP1" produced by the present applicant.

TABLE 1

| | | Alloy component (balance includes Cu) | | | | | Production Conditions | | | | | | |
|---|---|---|---|---|---|---|---|---|---|---|---|---|---|
| | | | | | | | Hot rolling | | | | | | Tension |
| | | | | | | | Rolling initiation | Total hot | Average | Cold rolling | Continuous annealing | | leveling Line |
| | | | | | | | temperature | rolling | rolling | Rolling | Temperature | Time | tension |
| | | Mg % | P % | C % | Oxygen % | Zr % | ° C. | rate % | rate/pass % | rate % | ° C. | (minute) | N/mm$^2$ |
| Example | 1 | 1.2 | 0.1 | | | | 700 | 80 | 15 | 50 | 300 | 8 | 110 |
| | 2 | 0.2 | 0.008 | | | | 750 | 85 | 20 | 60 | 350 | 7 | 10 |
| | 3 | 0.8 | 0.001 | | | | 720 | 85 | 25 | 70 | 400 | 0.1 | 20 |
| | 4 | 0.5 | 0.2 | | | | 730 | 83 | 23 | 55 | 450 | 0.5 | 30 |
| | 5 | 0.7 | 0.15 | 0.0002 | 0.001 | | 760 | 88 | 18 | 65 | 500 | 2.5 | 140 |
| | 6 | 0.8 | 0.001 | 0.0013 | 0.002 | | 780 | 85 | 28 | 60 | 480 | 10 | 130 |
| | 7 | 0.2 | 0.008 | 0.0008 | 0.0008 | | 790 | 83 | 16 | 50 | 550 | 3 | 120 |
| | 8 | 1.2 | 0.1 | | | 0.01 | 800 | 85 | 30 | 65 | 520 | 5 | 90 |
| | 9 | 0.4 | 0.003 | 0.0013 | 0.0002 | 0.001 | 720 | 90 | 25 | 70 | 500 | 4 | 70 |
| | 10 | 0.6 | 0.005 | 0.0002 | 0.0009 | 0.03 | 730 | 83 | 20 | 55 | 450 | 0.9 | 60 |
| Comparative Example | 1 | 1.2 | 0.1 | | | | 720 | 85 | 25 | 55 | 450 | 1.5 | 5 |
| | 2 | 0.2 | 0.008 | | | | 730 | 80 | 18 | 60 | 570 | 12 | 90 |
| | 3 | 1.5 | 0.2 | | | | 730 | 83 | 23 | 55 | 450 | 0.5 | 30 |
| | 4 | 0.7 | 0.15 | 0.0002 | 0.001 | | 650 | 75 | 12 | 60 | 250 | 11 | 150 |
| | 5 | 0.4 | 0.003 | 0.0013 | 0.0002 | 0.001 | 760 | 88 | 18 | 65 | 280 | 0.05 | 155 |
| | 6 | 0.5 | 0.2 | | | | 725 | 80 | 18 | 45 | 250 | 13 | 4 |
| | 7 | 0.1 | 0.003 | | | | 650 | 75 | 12 | 55 | 250 | 11 | 150 |

Samples were cut from these thin copper alloy sheets, and X-ray diffraction intensity (X-ray diffraction integrated intensity) of a {110} crystal plane, {100} crystal plane, and a {111} crystal plane was measured using an X-ray diffraction device.

Measurement of the X-ray diffraction intensity was carried out by measurement of an inverse pole figure using RIGAKU RINT 2500 rotary counter electrode type X-ray diffraction device. A sheet surface (rolling surface) of the copper alloy sheet of each sample was polished using #1500 water-resistant paper, and with respect to the sample surface, the X-ray diffraction intensity I of each crystal plane was measured under conditions of Mo—Kα rays, a curved monochromator formed from graphite, a tube voltage of 60 kV, and a tube current of 200 mA. After being press-molded to have a thickness of 2 mm, pure copper standard powder was subjected to the same measurement.

Results thereof are shown in Table 2.

In addition, with regard to the average grain size of each sample, the sheet surface (rolling surface) of the copper alloy sheet was polished and etched, the resultant surface was observed by an optical microscope, and the average grain size was measured by an intercept method according to JISH0501.

Results thereof are shown in Table 2.

TABLE 2

| | | X-ray diffraction intensity ratio | | | Average grain size μm |
|---|---|---|---|---|---|
| | | I{110}/$I_0${110} | I{100}/$I_0${100} | I{111}/$I_0${111} | |
| Example | 1 | 4.0 | 0.7 | 0.6 | 1.0 |
| | 2 | 5.5 | 0.8 | 0.7 | 9.0 |
| | 3 | 4.5 | 0.3 | 0.8 | 7.5 |
| | 4 | 5.8 | 0.4 | 0.5 | 6.3 |
| | 5 | 4.2 | 0.5 | 0.4 | 2.0 |
| | 6 | 5.3 | 0.4 | 0.2 | 8.5 |
| | 7 | 4.8 | 0.2 | 0.4 | 3.6 |
| | 8 | 5.9 | 0.3 | 0.2 | 10.0 |
| | 9 | 6.0 | 0.5 | 0.3 | 8.5 |
| | 10 | 4.2 | 0.6 | 0.3 | 2.8 |
| Comparative Example | 1 | 3.0 | 0.4 | 0.8 | 5.5 |
| | 2 | 69.0 | 1.1 | 1.1 | 7.5 |
| | 3 | 7.5 | 1.2 | 1.1 | 10.5 |
| | 4 | 2.5 | 1.5 | 1.3 | 11.5 |
| | 5 | 2.8 | 1.3 | 1.1 | 10.5 |
| | 6 | 2.6 | 1.5 | 1.4 | 11.3 |
| | 7 | 2.1 | 2.3 | 1.3 | 15.6 |

Next, electrical conductivity, tensile strength, a stress relaxation rate, and a bending elastic limit of each sample were measured.

The electrical conductivity was measured according to a electrical conductivity measurement method of JISH0505.

With regard to the tensile strength, five test specimens (No. 5 test specimens of JISZ2201) were collected for each tensile test of an LD (rolling direction) and a TD (a direction perpendicular to the rolling direction and the sheet thickness direction), and the tensile test according to JISZ2241 was carried out for each test specimen to obtain tensile strength of the LD and TD by an average value.

With regard to the stress relaxation rate, a test specimen having dimensions of a width of 12.7 mm and a length of 120 mm (hereinafter, the length of 120 mm was referred to as L0) was used, and this test specimen was set in a jig having a horizontal and longitudinal groove having a length of 110 mm and a depth of 3 mm to be curved in such a manner that the center of the test specimen swelled toward an upper side (at this time, the distance 110 mm between both ends of the test specimen was set as L1). At this state, the test specimen was retained at a temperature of 170° C. for 1000 hours, and was heated. Then, a distance (hereinafter, referred to as L2) between both ends of the test specimen in a state of being detached from the jig was measured. The stress relaxation rate was obtained by a calculation formula of (L0−L2)/(L0−L1)×100%.

With regard to the bending elastic limit, permanent deflection was measured by a moment type test on the basis of JIS-H3130, and Kb0.1 (surface maximum stress value at fixed end which corresponds to permanent deflection of 0.1 mm) at R.T. was calculated.

These results are shown in Table 3.

TABLE 3

| | | Electrical conductivity % IACS | Tensile strength N/mm$^2$ | Stress relaxation rate % | Bending elastic limit Kb0.1 |
|---|---|---|---|---|---|
| Example | 1 | 63 | 510 | 18 | 386 |
| | 2 | 60 | 570 | 12 | 385 |
| | 3 | 65 | 519 | 17 | 386 |
| | 4 | 63 | 535 | 16 | 385 |
| | 5 | 63 | 548 | 13 | 386 |
| | 6 | 63 | 563 | 14 | 386 |
| | 7 | 64 | 555 | 14 | 385 |
| | 8 | 65 | 575 | 12 | 388 |
| | 9 | 65 | 570 | 12 | 388 |
| | 10 | 65 | 573 | 15 | 389 |
| Comparative Example | 1 | 60 | 515 | 12 | 385 |
| | 2 | 61 | 510 | 20 | 385 |
| | 3 | 55 | 495 | 22 | 355 |
| | 4 | 58 | 505 | 22 | 363 |
| | 5 | 61 | 510 | 20 | 386 |
| | 6 | 60 | 520 | 25 | 355 |
| | 7 | 55 | 480 | 25 | 355 |

In addition, with regard to the fatigue resistance characteristics of each sample, each sample was retained at an ordinary temperature and 150° C. for 1000 hours, respectively, and a fatigue resistance test was carried out according to T308-2002 of Japan Copper and Brass Association to create an S-N curve of maximum bending stress−the number of times of vibration (the number of times until reaching fracture). From the results, a reduction rate of maximum bending stress was obtained by dividing (maximum bending stress at an ordinary temperature−maximum bending stress after retention at 150° C. for 1000 hours) by (maximum bending stress at an ordinary temperature).

The results are shown in Table 4.

TABLE 4

| | | | Number of times of repetitive vibration (N) | | | | | |
|---|---|---|---|---|---|---|---|---|
| | | | 6400000 | 1400000 | 500000 | 140000 | 61000 | 28000 |
| Example | 1 | Reduction rate of maximum bending stress (%) | 18.5 | 19.5 | 15.7 | 15.2 | 15.3 | 15.8 |
| | 2 | Same as above | 16.7 | 16.9 | 15.6 | 16.8 | 16.3 | 16.3 |
| | 3 | Same as above | 17.5 | 17.1 | 17.3 | 17.8 | 16.5 | 15.7 |
| | 4 | Same as above | 16.5 | 16.4 | 15.4 | 15.5 | 15.4 | 15.2 |
| | 5 | Same as above | 15.8 | 15.6 | 16.9 | 17.1 | 18.3 | 15.6 |
| | 6 | Same as above | 16.2 | 17.3 | 16.8 | 15.8 | 17.5 | 15.4 |
| | 7 | Same as above | 16.8 | 16.3 | 17.2 | 15.4 | 16.3 | 17.2 |
| | 8 | Same as above | 16.2 | 15.7 | 15.8 | 15.3 | 15.7 | 15.3 |

TABLE 4-continued

| | | | Number of times of repetitive vibration (N) | | | | | |
|---|---|---|---|---|---|---|---|---|
| | | | 6400000 | 1400000 | 500000 | 140000 | 61000 | 28000 |
| | 9 | Same as above | 15.6 | 15.4 | 15.6 | 15.6 | 15.8 | 15.2 |
| | 10 | Same as above | 15.7 | 15.3 | 15.7 | 15.8 | 15.6 | 15.5 |
| Comparative Example | 1 | Same as above | 20.5 | 24.3 | 22.3 | 23.6 | 24.3 | 22.3 |
| | 2 | Same as above | 22.3 | 25.5 | 24.5 | 23.5 | 25.5 | 23.8 |
| | 3 | Same as above | 28.9 | 26.8 | 23.5 | 28.1 | 28.3 | 27.8 |
| | 4 | Same as above | 28.9 | 25.9 | 25.7 | 23.4 | 24.3 | 25.1 |
| | 5 | Same as above | 23.7 | 24.4 | 24.3 | 24.5 | 25.1 | 25.8 |
| | 6 | Same as above | 24.6 | 23.2 | 24.4 | 24.5 | 25.8 | 25.2 |
| | 7 | Same as above | 28.9 | 25.1 | 28.4 | 28.5 | 28.2 | 27.9 |

From the results of Table 1, Table 2, Table 3, and Table 4, it can be understood that the reduction rate of the fatigue resistance characteristics after retention at 150° for 1000 hours in the Cu—Mg—P-based copper alloy sheets of Examples of the invention is smaller compared to Comparative Examples, and characteristics in the related art are maintained.

Hereinbefore, the embodiment of the invention has been described. However, the invention is not limited to this description, and various modifications may be made within a range not departing from the gist of the invention. For example, a production method in which the cold rolling and continuous annealing are repetitively carried out, a production method in which a stress relieving annealing is carried out after the tension leveling, and the like may be exemplified.

INDUSTRIAL APPLICABILITY

The Cu—Mg—P-based copper alloy sheet having excellent fatigue resistance characteristics of the invention is applicable to a material for terminal and connectors of electric and electronic apparatuses.

REFERENCE SIGNS LIST

6: Copper alloy sheet
7: Copper alloy sheet
8: Copper alloy sheet
9: Uncoiler
10: Tension leveler
11: Inlet-side tension loading device
12: Winding-side tension loading device
13: Roller leveler
14: Recoiler
L: Line tension

The invention claimed is:

1. A Cu—Mg—P-based copper alloy sheet having excellent fatigue resistance characteristics which has a composition containing:

0.2% by mass to 1.2% by mass of Mg; and 0.001% by mass to 0.2% by mass of P, the balance being Cu and unavoidable impurities, wherein when X-ray diffraction intensity of a {110} crystal plane is set as I{110}, and X-ray diffraction intensity of a {110} crystal plane of a pure copper standard powder is set as $I_0\{110\}$, a surface crystal orientation of the copper alloy sheet satisfies a relation of $4.0 \leq \{110\}/I_0\{110\} \leq 6.0$, when X-ray diffraction intensity of a {100} crystal plane is set as I{100}, and X-ray diffraction intensity of a {100} crystal plane of the pure copper standard powder is set as $I_0\{100\}$, the surface crystal orientation of the copper alloy sheet satisfies a relation of $I\{100\}/I_0\{100\} \leq 0.8$, when X-ray diffraction intensity of a {111} crystal plane is set as I{111}, and X-ray diffraction intensity of a {111} crystal plane of the pure copper standard powder is set as $I_0\{111\}$, the surface crystal orientation of the copper alloy sheet satisfies a relation of $I\{111\}/I_0\{111\} \leq 0.8$, and an average grain size of the copper alloy sheet is 1.0 μm to 10.0 μm.

2. The Cu—Mg—P-based copper alloy sheet having excellent fatigue resistance characteristics according to claim 1, further containing:

0.0002% by mass to 0.0013% by mass of C, and 0.0002% by mass to 0.001% by mass of oxygen.

3. The Cu—Mg—P-based copper alloy sheet having excellent fatigue resistance characteristics according to claim 1, further containing:

0.001% by mass to 0.03% by mass of Zr.

4. The Cu—Mg—P-based copper alloy sheet having excellent fatigue resistance characteristics according to claim 2, further containing:

0.001% by mass to 0.03% by mass of Zr.

5. A method of producing the Cu—Mg—P-based copper alloy sheet having excellent fatigue resistance characteristics according to claim 1, the method comprising:

a process of carrying out hot rolling, cold rolling, continuous annealing, finish cold rolling, and tension leveling in this order to produce the copper alloy sheet, wherein the hot rolling is carried out under conditions in which a hot rolling initiation temperature is 700° C. to 800° C., a total hot-rolling rate is 80% or more, and an average hot rolling rate for one pass is 15% to 30%, the cold rolling is carried out at a cold rolling rate of 50% or more, the continuous annealing is carried out at a temperature of 300° C. to 550° C. for 0.1 minutes to 10 minutes, and the tension leveling is carried out at a line tension of 10 $N/mm^2$ to 140 $N/mm^2$.

6. A method of producing the Cu—Mg—P-based copper alloy sheet having excellent fatigue resistance characteristics according to claim 2, the method comprising:

a process of carrying out hot rolling, cold rolling, continuous annealing, finish cold rolling, and tension leveling in this order to produce the copper alloy sheet, wherein the hot rolling is carried out under conditions in which a hot rolling initiation temperature is 700° C. to 800° C., a total hot-rolling rate is 80% or more, and an average hot rolling rate for one pass is 15% to 30%, the cold rolling is carried out at a cold rolling rate of 50% or more, the continuous annealing is carried out at a temperature of 300° C. to 550° C. for 0.1 minutes to 10 minutes, and the tension leveling is carried out at a line tension of 10 $N/mm^2$ to 140 $N/mm^2$.

7. A method of producing the Cu—Mg—P-based copper alloy sheet having excellent fatigue resistance characteristics according to claim 3, the method comprising:

a process of carrying out hot rolling, cold rolling, continuous annealing, finish cold rolling, and tension leveling in this order to produce the copper alloy sheet, wherein the hot rolling is carried out under conditions in which a hot rolling initiation temperature is 700° C. to 800° C., a total hot-rolling rate is 80% or more, and an average hot rolling rate for one pass is 15% to 30%, the cold rolling is carried out at a cold rolling rate of 50% or more, the continuous annealing is carried out at a temperature of 300° C. to 550° C. for 0.1 minutes to 10 minutes, and the tension leveling is carried out at a line tension of 10 $N/mm^2$ to 140 $N/mm^2$.

8. A method of producing the Cu—Mg—P-based copper alloy sheet having excellent fatigue resistance characteristics according to claim 4, the method comprising:

a process of carrying out hot rolling, cold rolling, continuous annealing, finish cold rolling, and tension leveling in this order to produce the copper alloy sheet, wherein the hot rolling is carried out under conditions in which a hot rolling initiation temperature is 700° C. to 800° C., a total hot-rolling rate is 80% or more, and an average hot rolling rate for one pass is 15% to 30%, the cold rolling is carried out at a cold rolling rate of 50% or more, the continuous annealing is carried out at a temperature of 300° C. to 550° C. for 0.1 minutes to 10 minutes, and the tension leveling is carried out at a line tension of 10 $N/mm^2$ to 140 $N/mm^2$.

* * * * *